United States Patent [19]

Quinnell

[11] 4,442,641

[45] Apr. 17, 1984

[54] VERGE MEMBER FOR A PITCHED ROOF AND ROOFING SYSTEM INCORPORATING THE SAME

[75] Inventor: Geoffrey C. Quinnell, Pembury, England

[73] Assignee: Marley Tile A.G., Switzerland

[21] Appl. No.: 287,567

[22] PCT Filed: Nov. 28, 1980

[86] PCT No.: PCT/GB80/00205

§ 371 Date: Jul. 28, 1981

§ 102(e) Date: Jul. 28, 1981

[87] PCT Pub. No.: WO81/01583

PCT Pub. Date: Jun. 11, 1981

[30] Foreign Application Priority Data

Oct. 28, 1979 [GB] United Kingdom ..... 7940986

[51] Int. Cl.[3] ..... E04D 13/15

[52] U.S. Cl. ..... 52/94; 52/277

[58] Field of Search ..... 52/94, 95, 96, 277, 52/537, 538, 726, 729, 738, 56

[56] References Cited

U.S. PATENT DOCUMENTS

| | | | |
|---|---|---|---|
| 2,358,396 | 9/1944 | Hogan | 52/94 X |
| 2,380,398 | 7/1945 | Booth | 52/96 |
| 3,332,197 | 7/1967 | Hinkle | 52/738 X |
| 3,846,031 | 11/1974 | Adams | 52/726 X |

FOREIGN PATENT DOCUMENTS

| | | | |
|---|---|---|---|
| 496136 | 5/1977 | Australia | 52/94 |
| 24228 | 2/1981 | European Pat. Off. | 52/94 |
| 2407312 | 6/1979 | France . | |
| 1500118 | 2/1978 | United Kingdom | 52/95 |

*Primary Examiner*—Alfred C. Perham

*Attorney, Agent, or Firm*—Bacon & Thomas

[57] ABSTRACT

A verge member (1) for a pitched roof comprises a tapered planar portion (2) and a pair of flanges (5) and (6) defining a channel (7) for capping the edge of a tile. Also provided is a third flange (8). To assist in interlocking of members, and to improve appearance, along the upper edge of the member is provided a longitudinally extending protruding element (14). Element (14) is provided with a tongue (15) at one end, and the other end of the member is provided with a cut-out (21) to assist in interlocking with the tongue. In a roofing system incorporating the verge members, the members are telescopically engaged and cap the complete verge of the roof.

9 Claims, 11 Drawing Figures

1
1'
2
3
4
5
6
7
8
9
12
13
14
15
17
21
28
29
A
A

VERGE MEMBER FOR A PITCHED ROOF AND ROOFING SYSTEM INCORPORATING THE SAME

This invention relates to a verge member for a pitched roof, having a plurality of overlapping tiles or other units.

In German Patent Application No. P 28 46 275.1 there is disclosed a verge system comprising a plurality of individual verge members adapted to overlap one another, each member being provided with a channel adapted to cap the upper and lower faces of a tile or other unit adjacent the free edge thereof. By "free edge" is meant the edge of a tile or other unit, adjacent the verge of the roof. A verge member for use in such a system has a longitudinally extending planar portion tapering in height from the one of the member to the other, and a pair of longitudinally extending, spaced flanges extending substantially normal to said portion and defining a channel of substantially constant width extending therealong. Preferably one of said flanges extends along one edge of the planar portion and there is advantageously a third flange extending from the other edge of the member, in the same direction as the other two flanges. The member may be made of a suitable plastics such as P.V.C., or be for example P.V.C. covered steel. The verge members can overlap by being telescoped, one within the other.

Such a system enables a traditional, stepped appearance to be obtained. Furthermore, by capping both the upper and lower faces of a tile, the passage of water beneath the tile, for example as a result of water being blown across the roof can be restricted. The flow of water down the roof is kept at the level of the tiles so that it can be fed to an eaves gutter.

Whilst such a system does enable a stepped appearance to be obtained, the tile edges are covered by the verge members. The system dows not therefore completely reproduce a traditional verge. This is now developed an improved verge member which has an improved appearance and which at the same time is provided with means for improving the interengagement of one member with a like member.

According to the invention there is provided a verge member for a pitched roof, comprising a longitudinally extending planar portion tapering in height from one end of the member to the other, a first flange substantially normal to said planar portion and extending along the upper edge thereof, a second flange substantially normal to said planar portion and extending therealong, said second flange being spaced from said first flange and defining therewith a channel of substantially constant height for receiving the edge of a tile or like unit, and a protruding element extending along said planar portion adjacent the upper edge thereof on the side remote from said flanges, there being defined between said element and the face of the planar portion, a space extending along the planar portion from the shorter end thereof, whereby said member may be telescopically engaged wih a like member, with said protruding element overlying the planar portion of said like member.

Thus, the engagement of two members is improved, since the planar portion of one will be located in the space between the planar portion and protruding element of the other. The space should desirably be substantially equal to the thickness of the planar portion. Furthermore the protruding element can simulate the appearance of the edge of a tile. The element could for example be of contrasting colour or finish to the remainder of the verge member, so as to enhance this effect. The element desirably has a height substantially equal to the height of the channel.

The protruding element could be a separate element mounted on said planar portion. Preferably however the element is integrally formed e.g. moulded with the planar portion. In this case the element may be in the form of stepped region of said planar portion.

Preferably, a second protruding element is provided adjacent the lower edge of the planar portion, there likewise being a space between the second protruding element and the shorter end thereof. Thus location of the lower region of the planar portion of a like member may be effected. Furthermore, the second element can simulate the edge of an undercloak of e.g. tile or slate. The second protruding element itself could terminate along the verge member at a distance from the taller end thereof at least as great as the amount of overlap of two members. Preferably however, and to assist in engaging one member with another, the second protruding element extends further towards the taller end of the member and is provided with a channel so as to permit overlapping and interengagement of two members. Either or both of the protruding elements could terminate a distance from the shorter end of the verge member, although this will reduce the extent of locating engagement with a like member. In the case of the second protruding element, this may be desirable to give the desired appearance. Preferably, however, the first protruding element extends beyond the shorter end of the member, to assist in location. The planar portion is desirably provided with a cut out. Preferably, a third flange is provided, substantially normal to the planar portion and extending along the other edge of the member in the same direction as the other two flanges. Advantageously, an element extends between the second and third flanges at the ends thereof adjacent the shorter end of the verge member. Such an element can be used in locating the verge member on e.g. a batten, and may be provided with one or more holes to receive a nail or the like.

Additionally or alternatively fixing holes may be provided in the planar portion adjacent the shorter end thereof. A blocking element may be provided, extending downwardly from one end of the first flange, at the end thereof adjacent the taller end of the verge member. This will improve the weathering of a tile. The blocking element should advantageously stop short of the second flange, so as to permit the free flow of water down the verge member. The free flow of water may also be encouraged by terminating the second flange at a distance from the taller end of the verge member.

For use at the bottom of the verge, a member may be provided with a blanking piece extending between the second and third flanges.

The invention also extends to a verge system for a pitched roof, employing a plurality of verge members as described herein, telescopically engaged with each other. The system may be used with a ridge end cap of the type disclosed in co-pending PCT Application of even date herewith claiming priority from U.K. Application No. 8024104 and is desirably used in conjunction with the complete ridge system disclosed therein, the top verge member interlocking with the end cap.

Some embodiments of the invention will now be described by way of example and with reference to the accompanying drawings, in which.

Figures 1, 2, 3:
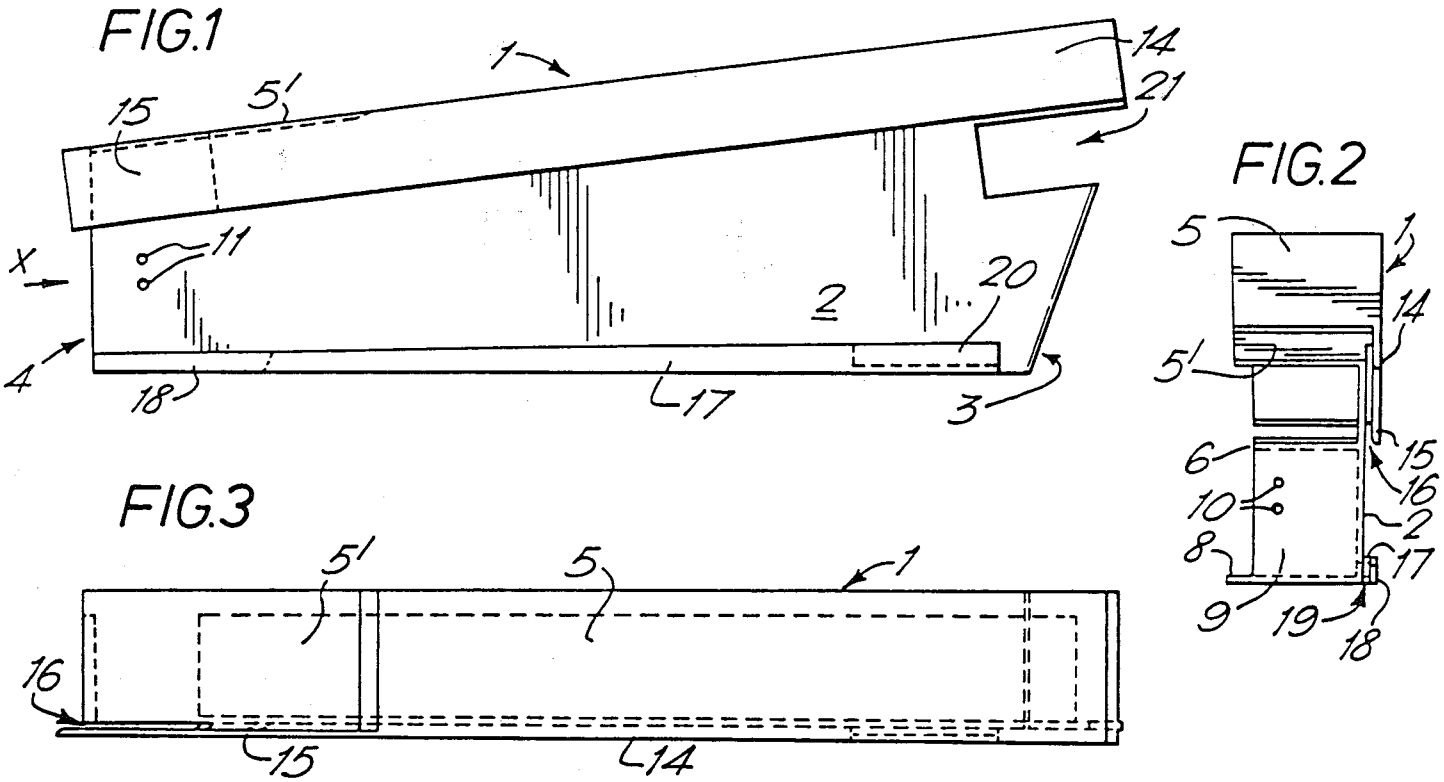
FIG. 1 is a side view of a verge member in accordance with the invention.
FIG. 2 is an end view in the direction of the arrow X on FIG. 1.
FIG. 3 is a top plan view of the member.

Referring now to the FIGS. 1 to 5 of the drawings, the verge member 1 includes a substantially planar portion 2 tapering in height from a tall end 3 to a short end 4. The taller end 3 of the planar portion 2 is angled. Along the upper edge of planar portion 2 extends a first flange 5 normal to the planar portion. Flange 5 has a thinned-down portion 5' at the shorter end 4 of the member. Beneath, and parallel to, flange 5 extends a second flange 6. Between flanges 5 and 6 is defined a channel 7 of constant height. Along the lower edge of portion 2 extends a third flange 8, normal thereto. A portion 9 extends between flanges 6 and 8, at the shorter end 4 of the member. Portion 9 is provided with two fixing holes 10. Fixing holes 11 are also provided, in planar portion 2 adjacent the shorter end 4. These enable fixing to the end of a tile batten, if required. Flange 6 terminates at a distance from the taller end 3 of the member, and a blocking portion 12 which extends from flange 5, terminates at a distance from the plane of flange 6. There is thus provided a gap 13 which, inter alia, serves to accommodate the increased thickness of tile commonly found at the lower end thereof.

Adjacent the upper edge of the portion 2 extends a protruding element 14, defined by a stepped region of portion 2. The protruding element extends the length of the verge member and is of constant height, slightly less than the height of the channel 7. Adjacent the shorter end 4 of the verge member, the protruding element 14 is in the form of a tongue 15, i.e. a re-entrant portion is formed as to define a space 16 between the element and the portion 2. The width of this space is slightly larger than the wall thickness of portion 2. The tongue 15 projects beyond the end of the verge member by a short distance, to assist in location when the member is telescopically engaged with a like member.

Along the lower edge of portion 2 extends a second protruding element 17. This is once again formed as a stepped region of portion 2, and tapers slightly towards the shorter end 4 of the member. Protruding element 17 terminates short of the taller end 3 of the verge member. Adjacent the shorter end of the member, element 17 is formed as a tongue 18 so as to define a space 19 between the element and the planar portion 2. Once again this will have a width slightly larger than the thickness of the wall of portion 2. The other end of the element 17 is provided with a channel 20, adapted to receive the tongue 18 of a like member when telescopically engaged therewith. At the taller end 3 of the member, planar portion 2 is provided with a cut-out 21 to interlock with tongue 15 of a like member when engaged therewith.

Figure 6:
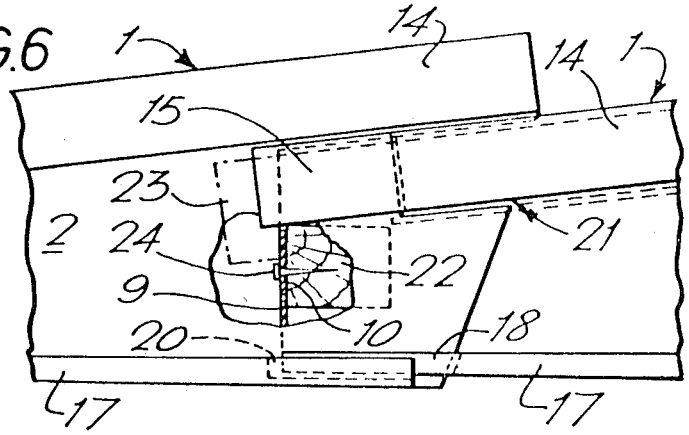
FIG. 6 is a view showing two verge members telescopically interengaged.

FIG. 6 shows two verge members interengaged telescopically. The right hand member 1 is received in the left hand member 1, but tongue 15 of element 14, and tongue 18 of element 17, of the right hand member, pass outside the portion 2 of the left hand member, tongue 18 being received in channel 20. The members are thus positively interengaged, the extent of telescopic engagement being variable within certain limits.

FIG. 6 also shows a tile batten 22 over which is is engaged the nib of a tile 23, the edge of which is received in the channel of right hand member 1. This member is secured to batten 22 by means of a nail or the like 24 passing through one of the holes 10 in portion 9. The second flange 6 is cut back to permit the verge member to be positioned with the base of channel 7 flush with the top of batten 22.

Figure 7:
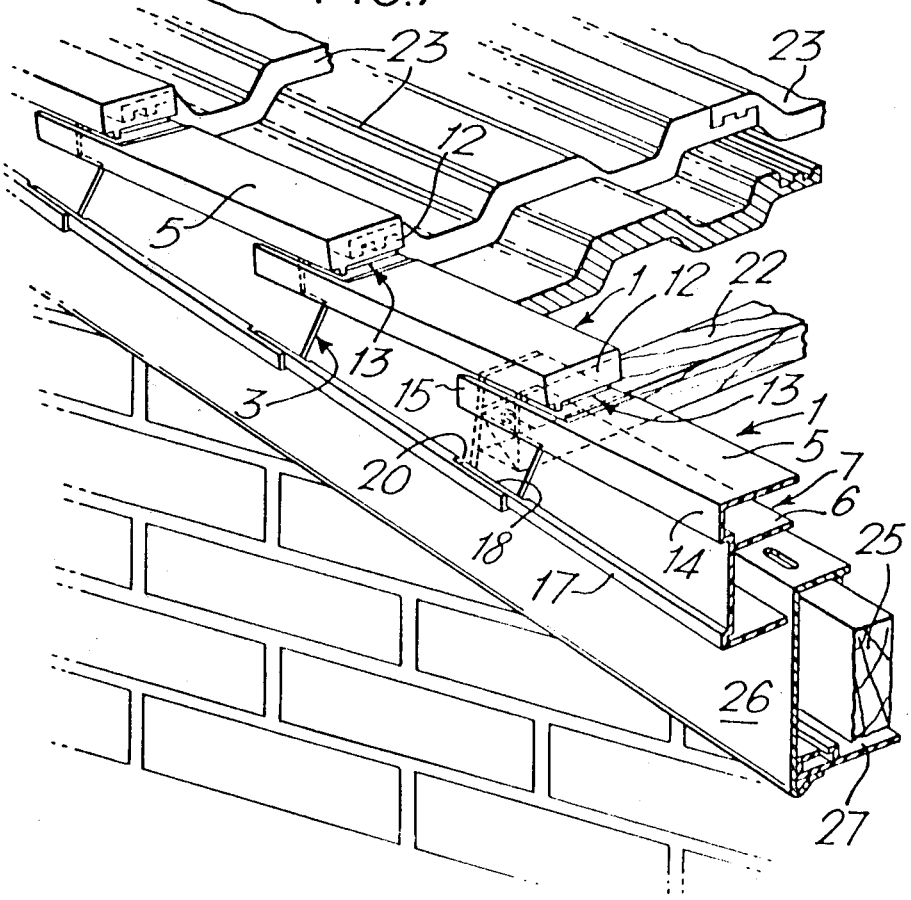
FIG. 7 is a perspective view showing a roofing system employing a plurality of interengaged verge members.

FIG. 7 shows how a plurality of the members 1 are arranged in a complete roofing system. The elements 14, which may be of contrasting colour or finish to the rest of the members 1, give an appearance similar to the tile edges in conventional systems. Elements 17, which once again may be of contrasing colour and/or finish, also give an authentic appearance. The blocking portions 12 cover the ends of tiles 23, the edges of which are received in channels 7, to improve the weathering. The angled taller ends 3 give an improved appearance.

Water can only enter the verge unit between the upper surface of a roof tile and the inside face of flange 5. Any water so doing will be drained down onto flange 6. From there is will flow down the verge unit and pass through gap 13 onto the upper surface of the next verge member. Thus, water can flow freely down the roof.

Also shown in FIG. 7 are a roof rafter 25, and a barge-board, 26, and soffit, 27 of known type.

Figures 4, 5, 8:
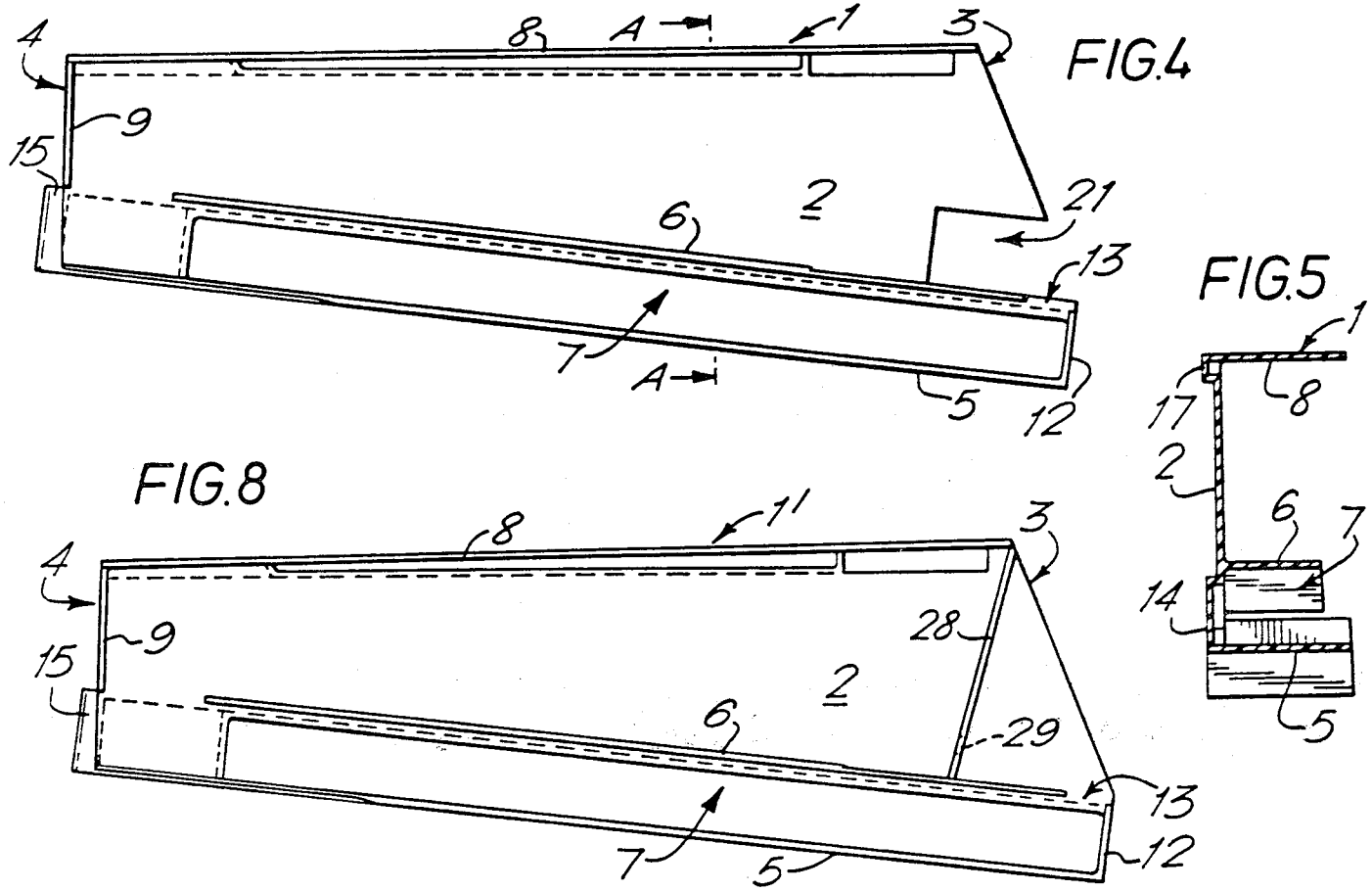
FIG. 4 is an inverted view of the member from the opposite side to that of FIG. 1.
FIG. 5 is a section on the line A—A of FIG. 4.
FIG. 8 is a view similar to FIG. 4 but of a modified member.

In FIG. 8 there is shown a modified member 1' similar in most respects to member 1. This member is intended for use at the bottom of a verge, at eaves level, and has an integrally moulded blanking piece 28 extending between flanges 6 and 8. No cut out is provided in the taller end of portion 2. The blanking piece 29 prevents the entry of birds, vermin or the like. An aperture 29 is provided to permit the use of a purpose designed non-corrosive metal wire hook fastener. This should be of a suitable length to permit it to be nailed to a convenient position on the top edge of a timber fascia board at eaves level.

Figure 9:
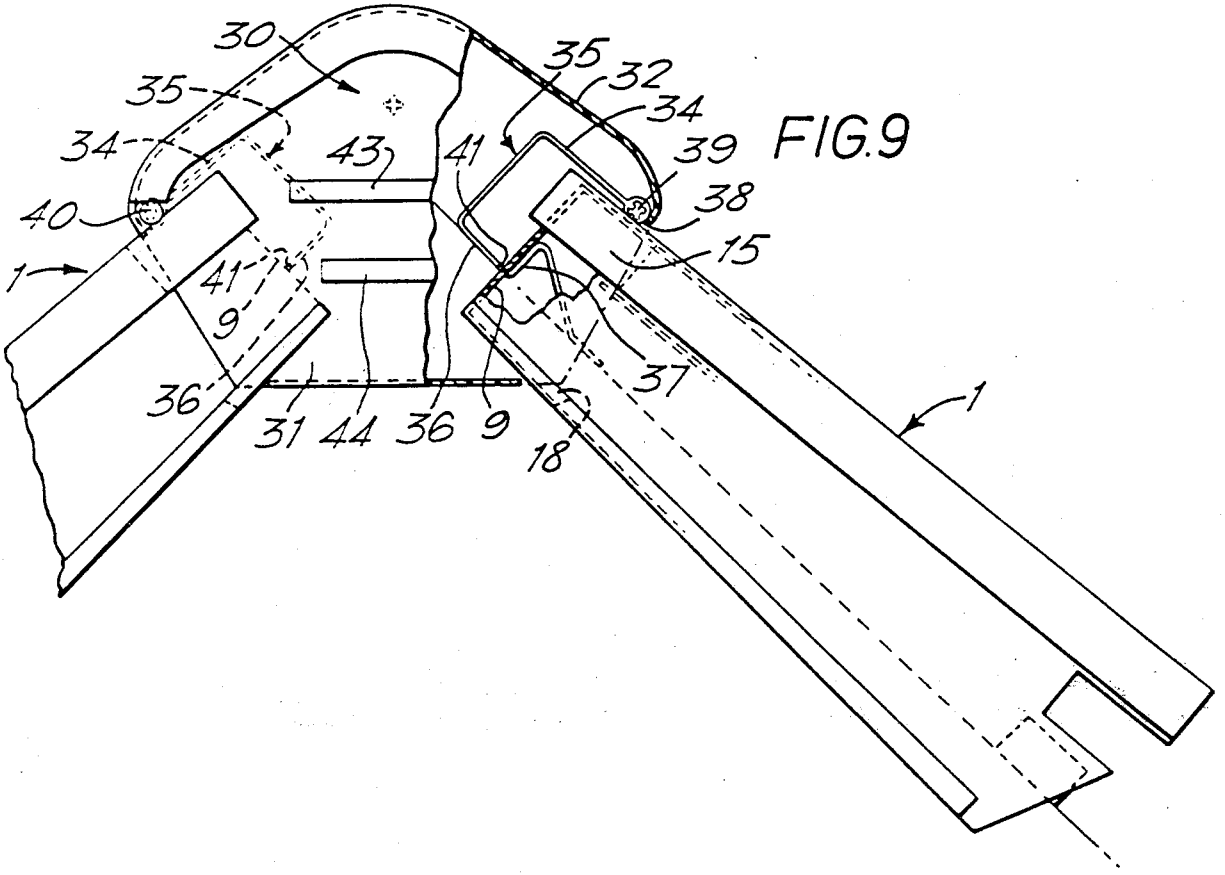
FIG. 9 is an end view of the verge members in conjunction with a ridge system.
Figure 10:
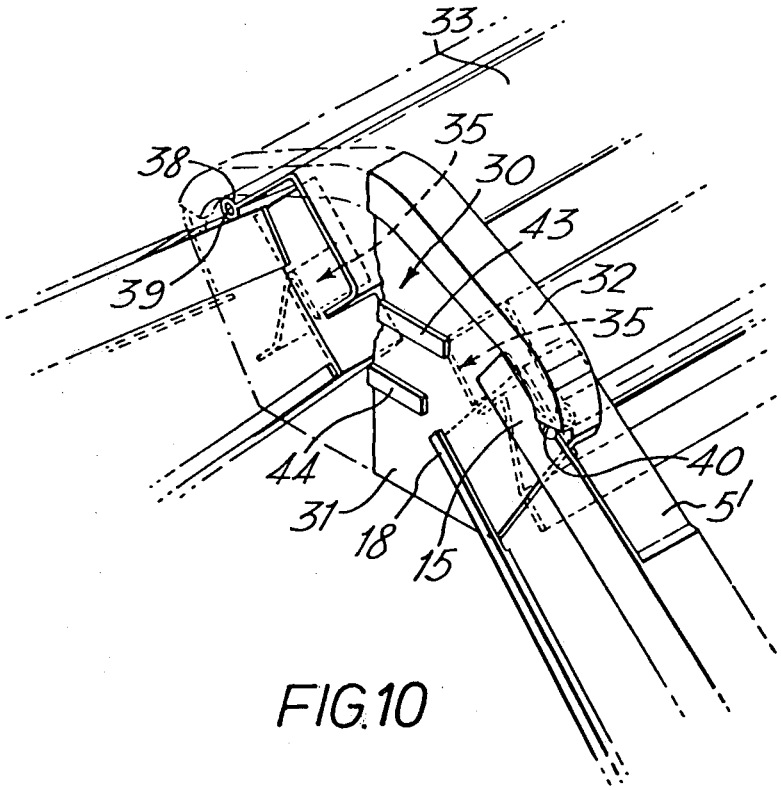
FIG. 10 is a perspective view of the arrangement of FIG. 9.

FIGS. 9 and 10 show, in somewhat diagrammatic form the verge system in combination with a roof ridge cap 30 of a type disclosed in the aforesaid co-pending PCT Application of even date herewith. The cap, which is of e.g. moulded plastics, or metal, comprises an end plate 31 having an upper peripheral flange 32 which both weathers and locates the end of a conventional ridge tile 33. The ridge tile, as with other ridge tiles (not shown) rests on top flanges 34 of elongate, extruded plastics, U-shaped members 35 positioned on either side of the roof ridge. Bottom flanges 36 of members 35 are provided with upwardly extending portions 37 over which nibs of the top line of roof tiles can engage, to locate the tiles. The members 35 are secured to the roof by appropriate means such as nails.

At the free end of the flanges 34 are provided enlarged portions 38 of circular cross section, with castelated bores 39 therethrough. The portions are used in conjunction with fixing straps (not shown) to locate ridge tiles along the roof, as described in said P.C.T. Application. The end cap is secured to the flange by means of screws 40 passing into these bores 39.

Flanges 36 are provided with longitudinal slots 41, sawn at the point of installation, to receive the portions 9 of the verge members 1. The verge members thus have their upper ends located. The tongues 15 and 18 of elements 14 and 17 respectively, pass outside plate 31 of end cap 30, to assist further in interlocking.

Figure 11:
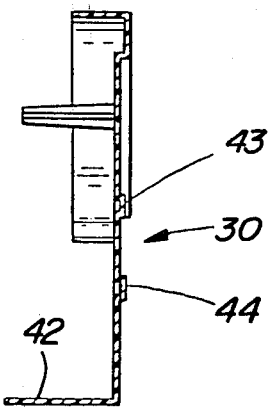
FIG. 11 is a section through the end cap used in FIGS. 9 and 10.

As shown in FIG. 11, the end cap 30 is provided with a lower flange 42 which improves weathering, and the appearance from underneath. Raised portions 43 and 44 are provided on plate 31, to simulate the appearance of tile slips used in conventional systems. A moulded spike is provided, to enable the end cap to be used with conventional ridge systems, the spike being embedded in mortar in that type of arrangement.

I claim:

1. A verge member (1) for a pitched roof, comprising a longitudinally extending planar portion (2) tapering in height from one end (3) of the member to the other (4), a first flange (5) substantially normal to said planar portion and extending along the upper edge thereof, a second flange (6) substantially normal to said planar portion and extending therealong, said second flange being spaced from said first flange and defining therewith a channel (7) of substantially constant height for receiving the edge of a tile or like unit, characterised by a protruding element (14) extending along said planar portion adjacent the upper edge thereof on the side remote from said flanges, there being defined between said element and the face of the planar portion a space (16) at least equal to the thickness of said planar portion, said space extending along the planar portion from the shorter end thereof, whereby said member may be telescopically engaged with a like member, with said protruding element overlying the planar portion of said like member.

2. A verge member as claimed in claim 1 further comprising a second protruding element (17) adjacent the lower edge of the planar portion and extending therealong, there being a space (19) between the second protruding element and the face of the planar portion at least equal to the thickness of the planar portion, said space extending along the planar portion from the shorter end thereof.

3. A verge member as claimed in claim 2 wherein the second protruding element (17) is provided with a channel (20) extending from adjacent the taller end of the planar portion to assist in interengagement of two like verge members.

4. A verge member as claimed in claim 1, 2 or 3 wherein the taller end of the planar portion is provided with a cut out (21) to interlock with the first protruding element when two like members are interengaged.

5. A verge member as claimed in claim 1 further comprising a third flange (8) substantially normal to said planar portion (2) and extending along the lower edge thereof.

6. A verge member as claimed in claim 1 wherein the second flange (6) terminates at a distance from the shorter end of the planar portion.

7. A verge member as claimed in claim 1 wherein at the taller end (3) of the member, the first flange (5) is provided with an inturned portion (12) directed towards the second flange (6).

8. A verge member as claimed in claim 5, for use at the eaves of a roof, wherein a blanking piece (28) extends between the second (6) and third (7) flanges adjacent the taller end (3) of the member.

9. A roof system comprising: a plurality of longitudinally overlapping and laterally engaged tiles (24) adjacent the verge of the roof and verge members (1) capping the tiles having a longitudinally extending planar portion (2) tapering in height from one end (3) of the member to the other (4), a first flange (5) substantially normal to said planar portion and extending along the upper edge thereof, a second flange (6) substantially normal to said planar portion and extending therealong, said second flange being spaced from said first flange and defining therewith a channel (7) of substantially constant height receiving the edge of a tile, a protruding element (14) extending along said planar portion adjacent the upper edge thereof on the side remote from said flanges, there being defined between said element and the face of the planar portion a space (16) at least equal to the thickness of said planar portion, said space extending along the planar portion from the shorter end thereof, said verge members being telescopically engaged with their taller ends (3) facing down the roof.

* * * * *